US007282847B2

(12) United States Patent
Versluijs et al.

(10) Patent No.: US 7,282,847 B2
(45) Date of Patent: Oct. 16, 2007

(54) ELECTRIC LAMP AND MANUFACTURING METHOD

(75) Inventors: Cornelis Versluijs, Eindhoven (NL); Johannes Andreas Zaat, Heerlen (NL); Henricus Adrianus Antonius Smits, Valkenswaard (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 6 days.

(21) Appl. No.: 10/494,825

(22) PCT Filed: Nov. 11, 2002

(86) PCT No.: PCT/IB02/04714

§ 371 (c)(1),
(2), (4) Date: May 7, 2004

(87) PCT Pub. No.: WO03/043056

PCT Pub. Date: May 22, 2003

(65) Prior Publication Data

US 2005/0029918 A1 Feb. 10, 2005

(30) Foreign Application Priority Data

Nov. 12, 2001 (EP) ..... 01204299

(51) Int. Cl.
*H01J 5/48* (2006.01)

(52) U.S. Cl. ..... 313/318.07; 313/318.12; 313/318.09; 313/318.1

(58) Field of Classification Search ..... 313/318.07, 313/318.01, 318.12, 318.09, 318.1, 25, 573, 313/611, 244, 252, 253, 257, 258, 266, 238, 313/50, 49, 26
See application file for complete search history.

(56) References Cited

U.S. PATENT DOCUMENTS

| | | | | |
|---|---|---|---|---|
| 3,739,221 | A * | 6/1973 | DeBleyker et al. | 313/318.1 |
| 3,960,278 | A * | 6/1976 | Vause | 439/617 |
| 4,339,685 | A * | 7/1982 | Saguchi et al. | 313/113 |
| 4,535,269 | A | 8/1985 | Tschetter et al. | |
| 4,538,090 | A | 8/1985 | Wilhelm et al. | |
| 5,339,001 | A * | 8/1994 | King et al. | 313/25 |
| 6,075,318 | A * | 6/2000 | Noll et al. | 313/573 |
| 6,469,428 | B1 * | 10/2002 | Thiel et al. | 313/318.09 |
| 2003/0168959 | A1 * | 9/2003 | Dakin et al. | 313/318.07 |

FOREIGN PATENT DOCUMENTS

| | | |
|---|---|---|
| DE | 2200736 | 8/1972 |
| EP | 0487142 | 11/1991 |
| EP | 0364831 | 5/1995 |
| EP | 1033742 | 7/2005 |

* cited by examiner

*Primary Examiner*—Karabi Guahary
*Assistant Examiner*—Anthony Canning

(57) ABSTRACT

The electric lamp has a lamp vessel having a pinch mounted in an outer envelope by means of a clamping member of metal sheet which is present on the pinch. The clamping member has an open loop which extends in a direction transverse to the broad side faces of the pinch. A still open clamping member, when present around the pinch, can easily be fastened by plastically deforming a specified region of the member by the method of the invention.

21 Claims, 2 Drawing Sheets

ELECTRIC LAMP AND MANUFACTURING METHOD

The invention relates to an electric lamp comprising:

an outer envelope carrying a lamp cap;

a gastight closed glass lamp vessel with an axis and a pinch around the axis, mounted in the outer envelope, which pinch is provided with a first and a second relatively broad side face, facing away from one another and having a smallest interspacing, and with, between the broad side faces, a first and a second, relatively narrow side face having a width that is greater than said smallest interspacing of the broad side faces;

an electric element in the lamp vessel, connected to current conductors which issue from the lamp vessel to the exterior;

electrical conductors connected to the lamp cap, entering the outer envelope, and connected to respective current conductors; and a clamping member bent from metal sheet, gripping around the first narrow side face, and pressing against the broad side faces to hold the lamp vessel, which clamping member is held positioned in the outer envelope.

The invention also relates to a method of manufacturing an electric lamp provided with a gastight closed glass lamp vessel with a pinch, which pinch has a first and a second relatively broad side face and relatively narrow, smaller side faces, by which method a clamping member, bent from metal sheet, is fitted on the pinch, which member will grip around one of the narrow side faces and will press against the broad side faces to hold the lamp vessel tight.

An embodiment of such an electric lamp is available on the market.

In the known lamp, the clamping member has the same shape as the clamping member used on the pinch of an H2 automotive lamp, where it serves as a contact for the electrical and mechanical connection of the lamp in a headlight.

The clamping member of the known lamp has a strip of metal sheet folded double, the end portions of which are bent apart, with ends that point at each other at an angle so as to form a dovetail-shaped space, accommodating the cross-sectionally dovetailed portion of the pinch. The clamping member thus has a symmetrical shape and extends with its folded portion to the side of the pinch, parallel to the broad faces. A current conductor is welded to the folded portion, and tongues are present on the folded portion in line with the lamp vessel, in between which tongues an electrical conductor is welded to keep the clamping member in place and to make contact with the electric element.

A drawback of the known lamp is that the lamp vessel with the clamping member is so bulky that it is difficult or even impossible to insert the vessel in the outer envelope if it has a relatively large pinch.

It is a first object of the invention to provide an electric lamp of the kind described in the opening section with a construction that makes the presence of a lamp vessel with a relatively big pinch possible.

A second object of the invention is to provide a manufacturing method of the kind described in the opening section that can be carried out quickly and easily.

According to one embodiment, a clamping member has an open loop with a base having a first and a second leg, the first leg extending from the base transversely to the broad side faces along the first narrow side face and hooking behind the first broad side face, and the second leg extending at a distance from the first leg to the second broad side face and pressing tightly against it while enclosing an acute angle therewith.

The clamping member of the lamp prevents that the dimension of the interior of the lamp is increased by the clamping member in the widthwise direction of the pinch. The clamping member extends mainly transversely to the broad faces and consequently its shape, unlike that of the known lamp, is asymmetrical. In this way it is possible, when assembling the lamp, to insert the lamp vessel with the clamping member through an opening, which is usually round, into the outer envelope, even if the broad side faces are relatively wide.

It is advantageous if the second leg has a curve with which it presses against the second broad side face. This counteracts the risk of, for example, a burr on the second leg making scratches in the second broad side face during mounting of the clamping member, which may lead to fracture.

For a firm grip on and a defined position of the pinch it is advantageous if the first leg extends along the first broad side face to the axis to form a first and, at a distance from this, a second axial contact line with the first broad side face, and if the second leg has a third contact line against the second broad side face, which, when projected perpendicularly on the first broad side face, lies between the first and the second contact line.

The clamping member can be bent open when it is mounted on the pinch and, after being fitted around the pinch, be released again to fix the pinch in position.

In a favorable embodiment, the second leg has a bend near the base, from where the leg runs at an acute angle to the second broad side face. This embodiment makes it easy to mount the clamping member on the pinch. The clamping member can then be "open" when fitted around the pinch, so that it can be positioned completely or almost completely without tension and with little or no friction. Subsequently, the second leg of the clamping member is forced near the base towards the first leg, causing a plastic deformation in that spot and providing an elastic deformation in the second leg, away from the base. Due to the elastic deformation, the clamping member subsequently keeps the pinch fixed in position. The plastic deformation prevents the second leg from springing back too much after the treatment and causing the pinch to be insufficiently clamped.

For the realization of the local plastic deformation it is favorable for the base to be relatively stiff. In this way, the plastic deformation is realized mainly by a change of the direction in which the second leg rests on the base. A relatively stiff base may be realized, for example, by the presence of an elongated embossment in the base from leg to leg.

It is, however, easy to arrange that the legs link up with the base on bending lines, and that the base is substantially flat.

In a favorable embodiment, the clamping member has a tongue to which a support is fixed which keeps the clamping member in position. The support may be one of the electrical conductors. Alternatively, the support may be a rod connected to the outer envelope, for example, if the outer envelope is connected to, for example fused to, a mount, or a rod embedded in the seal of the mount.

It is favorable if the tongue is an end portion of the first leg, transverse to the first broad side face. The tongue is then in a very favorable position for realizing the connection to the support.

In a favorable embodiment, the outer envelope is connected to a mount provided with a seal from which the electrical conductors enter the outer envelope, the pinch is between the electrical conductors, transverse to the seal, and the tongue is fixed to one of the electrical conductors as a support.

The advantage of this embodiment is that the construction of the contents of the outer envelope in the axial direction is very short.

The lamp may be an incandescent lamp, for example a halogen incandescent lamp, in which the electric element is an incandescent body in a halogen-containing gas, but it may alternatively be a discharge lamp, in which the electric element is a pair of electrodes in an ionizable gas. The lamp vessel may be made of quartz glass or hard glass. The outer envelope may be closed gastight and evacuated, or be filled with gas, but it may alternatively be in open connection with the surroundings of the lamp.

The clamping member may be made of brass or steel, for example soft spring steel, or, if it is mounted in its final shape on the pinch, of hardened spring steel.

The lamp cap may have any shape, for example provided with contact pins, or be of the Edison or bayonet type.

Another embodiment includes a clamping member that has an open loop with a base having a first and a second leg, the first leg extending away from the base transversely to the broad side faces, along a narrow side face and hooking behind the first broad side face, and the second leg being at a distance from the first one and having a bend near the base, from where it runs at an acute angle towards the second broad surface, and the second leg, when in the presence of the pinch, is plastically deformed near the base to ensure a clamping contact of the second leg with the second broad side face of the pinch.

Embodiments of the electric lamp and the method according to the invention are shown in the drawing, in which FIG. 1 shows an embodiment in side elevation, partly in cross section;

Corresponding components have been given the same reference numerals throughout the Figures.

Figure 1:
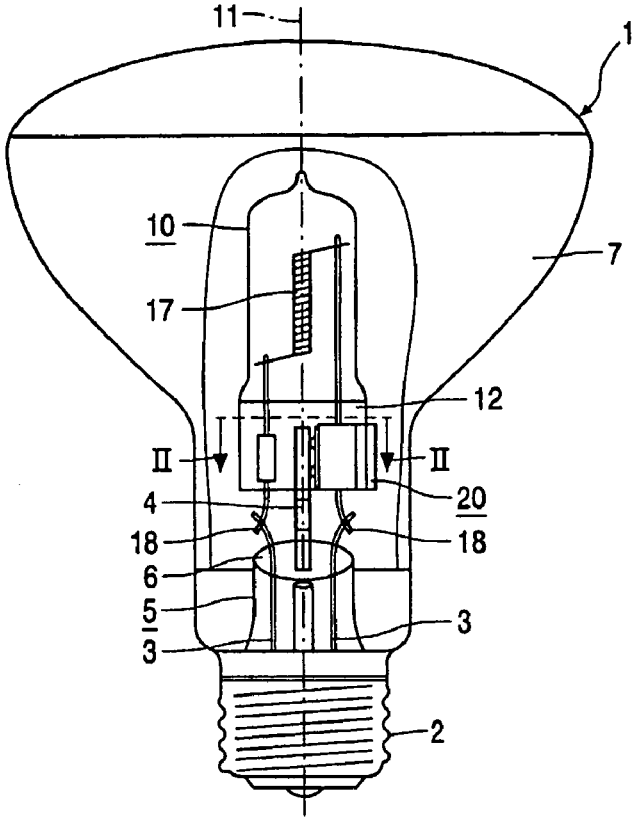
Figure 2:
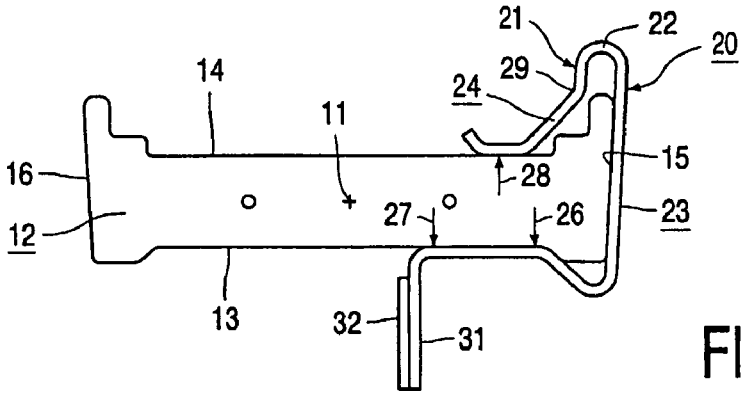
FIG. 2 shows a detail taken on the line II—II in FIG. 1.
Figure 3:
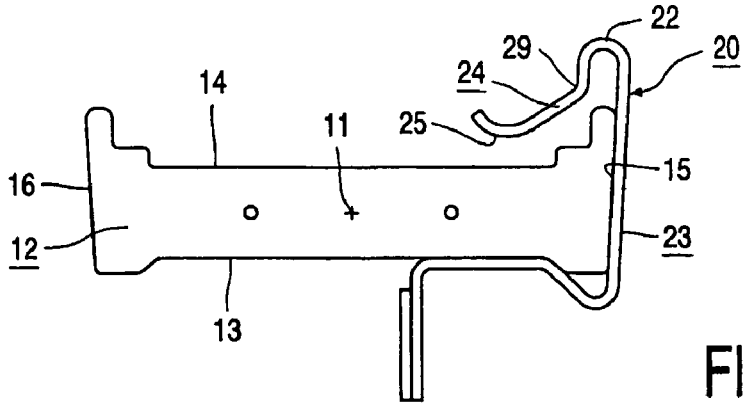
FIG. 3 shows the detail of FIG. 2 during manufacture.

The electric lamp of FIG. 1 has an outer envelope carrying a lamp cap 2. The outer envelope 1 has an aluminized mirror 7 and a mount 5. The mount 5 has a seal 6, in which a support 4 is embedded. A gastight closed glass lamp vessel 10, made of quartz glass in the Figure, with an axis 11 and a pinch 12 around the axis 11, is mounted in the outer envelope 1. The pinch 12, see also FIGS. 2 and 3, is provided with a first 13 and a second relatively broad side face 14, facing away from one another and having a smallest interspacing, and with, between the broad side faces 13, 14, a first 15 and a second, relatively narrow side face 16. The width of the narrow side faces 15, 16 is greater than the smallest interspacing of the broad side faces 13, 14. The pinch 12 is a so-termed limited pinch, that is to say, a pinch that is formed by heating a glass tube to the softening point and pinching it up. During pinching, however, not only the broad side faces are shaped with pinch blocks, but these blocks also shape folds formed at the sides of the broad side faces by flattening them to form the narrow side faces.

An electric element 17, in the Figure a tungsten incandescent body in an inert gas that comprises HBr, is mounted in the lamp vessel 10, connected to current conductors 18 issuing from the lamp vessel 10 to the exterior. Electrical conductors 3, which are connected to the lamp cap 2, enter the outer envelope 1 and are connected to respective current conductors 18. A clamping member 20, bent from metal sheet, grips around the first narrow side face 15 and presses against the broad side faces 13, 14 to hold the lamp vessel 10. The clamping member 20 is held positioned in the outer envelope 1 by support the 4. The pinch 12 of the lamp vessel 10 and the seal 6 of the mount 5 are axially spaced apart.

The clamping member 20, see also FIGS. 2 and 3, has an open loop 21 with a base 22 having a first 23 and a second leg 24, the first leg 23 extending from the base 22 transversely to the broad side faces 13, 14, along the first narrow side face 15 and hooking behind the first broad side face 13. As shown in FIGS. 2 and 3, the first leg 23 of the clamping member 20, extends beyond the first narrow side face 15 of the pinch 12. That is, the length of the clamping member's first leg 23 is larger than the length of the pinch's first narrow side face 23. The second leg 24 extends at a distance from the first one 23 to the second broad side face 14 and presses tightly against it. The second leg 24 encloses an acute angle with said side face 14.

The second leg 24 has a curve 25, see FIG. 3, with which it presses against the second broad side face 14.

The first leg 23 extends along the first broad side face 13 to the axis 11 to form a first axial contact line 26 and, at a distance from the first one, a second axial contact line 27 with the first broad side face 13. The second leg 24 has a third contact line 28 against the second broad side face 14, which, when projected perpendicularly on the first broad side face 13, lies between the first 26 and the second contact line 27.

The second leg 24 has a bend 29 near the base 22, from where the leg 24 runs at an acute angle to the second broad side face 14.

In FIG. 3, the "open" clamping member 20 is fitted around the pinch 12, but it still has to be pinched shut through plastic deformation of the second leg 24 near the base 22, between the bend 29 and the base 22, by forcing it towards the first leg 23.

Figure 4:
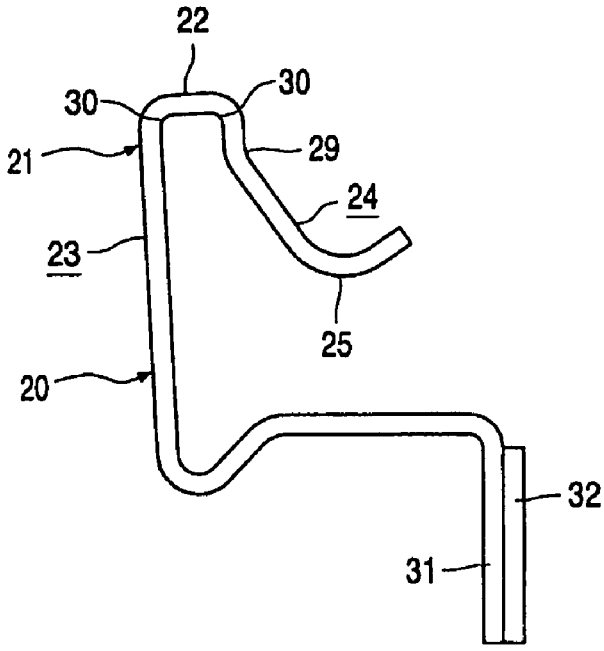
FIG. 4 shows another embodiment of the clamping member.

In the embodiment of FIG. 4, the base 22 of the clamping member 20 is relatively stiff. The legs 23, 24 link up with the base 22 on the bending lines 30, and the base 22 is substantially flat.

The clamping member 20, FIGS. 1, 2, 3, 4 and 5, has a tongue 31 to which the support 4 in FIG. 1 is fixed to keep the clamping member 20 in position. The tongue 31 is an end portion 31 of the first leg 23, which is transverse to the first broad side face 13.

It is not only favorable for the stability of the lamp vessel 1 in the clamping member 20 that the first leg 23 extends along the first broad side face 13 to the axis 11, but also for the centric positioning possibility of the lamp vessel 10 in the outer envelope 1, as shown in FIG. 1, where the centrally located support 5 is fixed to the tongue 31 on the first leg 23.

Figure 5:
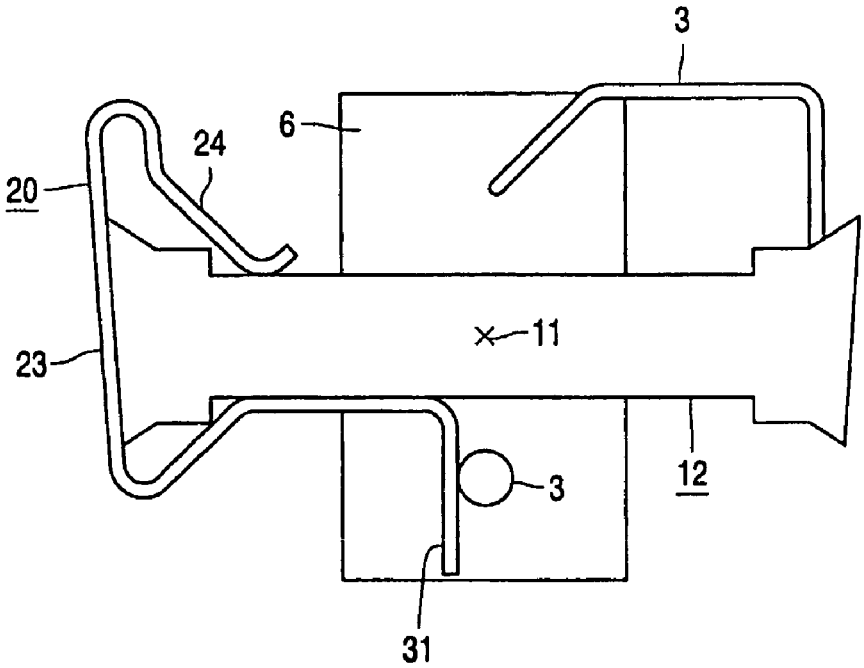
FIG. 5 shows a variant as in FIG. 2.

This is also reflected in FIG. 5. In this Figure, the pinch 12 is transverse to the seal 6, between the electrical conductors 3. The tongue is welded to a thick conductor 3 which has a relatively great stiffness because of its diameter. FIG. 5 shows that a centric position of the pinch 12 is also realized in the drawn configuration. An advantage of the arrangement of the pinch 12 between the electrical conductors is that the distance between the pinch 12 and the seal 6 can be minimal, so that the lamp can have a small axial dimension.

The tongues 31 of the previous Figures have elongated embossments 32, which are transverse to the support 4 or the electrical conductor 3 fixed thereto. The advantage of the embossments 32 is that they make a point contact with the support 4 and the conductor 3, so that it is easy to make a good-quality resistance weld.

The invention claimed is:

1. An electric lamp comprising:

an outer envelope carrying a lamp cap;

a gastight closed glass lamp vessel with an axis and a pinch around the axis, mounted in the outer envelope, wherein said pinch is provided with first and second relatively broad side faces, facing away from one another and having a smallest interspacing, and wherein first and second relatively narrow side faces are provided between the broad side faces, said narrow side faces having a width that is greater than said smallest interspacing of the broad side faces, an electric element in the lamp vessel, connected to current conductors which issue from the lamp vessel to the exterior;

electrical conductors connected to the lamp, entering the outer envelope and connected to respective current conductors; and a clamping member bent from metal sheet, gripping around the first narrow side face, and pressing against the broad side faces to hold the lamp vessel, which clamping member is held positioned in the outer envelope, wherein the clamping member has an open loop with a base having a first and a second leg, the first leg extending from the base transversely to the broad side faces along the first narrow side face and hooking behind the first broad side face, and the second leg extending at a distance from the first leg to the second broad side face and pressing tightly against it, while enclosing an acute angle therewith;

wherein the clamping member does not extend along an entire length of at least one of the first broad side face and the second broad side face.

2. The electric lamp as claimed in claim 1, wherein the second leg has a curve with which it presses against the second broad side face.

3. The electric lamp as claimed in claim 1, wherein the first leg extends along the first broad side face to the axis to form a first axial contact line and, at a distance therefrom, a second axial contact line with the first broad side face, and the second leg has a third contact line against the second broad side face which, when projected perpendicularly on the first broad side face, lies between the first and the second contact line.

4. An electric lamp as claimed in claim 3, wherein the second leg has a bend near the base, from where the leg runs at an acute angle to the second broad side face.

5. An electric lamp as claimed in claim 4, wherein the base is substantially stiff.

6. An electric lamp as claimed in claim 1, wherein the first leg and the second leg link up with the base on bending lines, and the base is substantially flat.

7. An electric lamp as claimed in claim 1, wherein the clamping member has a tongue to which a support is fixed, which support keeps the clamping member in position.

8. An electric lamp as claimed in claim 7, wherein the tongue is an end portion of the first leg which is transverse to the first broad side face.

9. An electric lamp as claimed in claim 7, wherein the outer envelope is connected to a mount provided with a seal from which the electrical conductors enter the outer envelope, the pinch is between the electrical conductors and transverse to the seal, and the tongue is fixed to one of the electrical conductors as the support.

10. A method of manufacturing an electric lamp provided with a gastight closed glass lamp vessel with a pinch, said pinch having first and second broad side faces, and first and second narrow side faces, by which method a clamping member, bent from metal sheet, is fitted on the pinch, which member will grip around one of the narrow side faces and will press against the broad side faces to hold the lamp vessel tight, wherein the clamping member is used that has an open loop with a base having a first and a second leg, the first leg extending from the base transversely to the broad side faces along one of the narrow side faces and hooking behind the first broad side face, and the second leg being at a distance from the first leg and having a bend near the base, from where the leg runs at an acute angle towards the second broad side face, and wherein the second leg, when in the presence of the pinch, is plastically deformed near the base to ensure a clamping contact of the second leg with the second broad side face of the pinch, and wherein the clamping member does not extend along an entire length of at least one of the first broad side face and the second broad side face.

11. A lamp comprising: a vessel having a vessel end; a pinch at said vessel end, said pinch having broad first and second surfaces facing away from one another and having a smallest interspacing, wherein first and second relatively narrow side faces are provided between the broad side faces, said narrow side faces having a width that is greater than said smallest interspacing of the broad surfaces; and a clamp configured to hold said pinch in a desired position; said clamp having a first leg, a second leg, a third leg and a fourth leg, said first leg being substantially along one of said narrow side faces, said second leg being substantially along said broad first surface, said third leg being substantially along said broad second surface, and said fourth leg connecting said first leg to said second leg; wherein the clamp does not extend along an entire length of at least one of the first broad side face and the second broad side face.

12. The lamp of claim 11, wherein said second leg makes an acute angle with said broad first surface.

13. The lamp of claim 11, wherein said second leg is resilient and has a curve configured to press against the broad first surface.

14. The lamp of claim 11, wherein a contact portion of said second leg that contacts said broad first surface is shorter than a contact part of said third leg that contacts said broad second surface.

15. The lamp of claim 14, wherein an image of said contact portion projected to said broad second surface is within said contact part.

16. The lamp of claim 11, wherein said clamp includes a curved portion connecting said first leg to said second leg.

17. The lamp of claim 11, wherein said clamp includes a base connecting said first leg to said second leg.

18. The lamp of claim 17, wherein said base is substantially flat.

19. The lamp of claim 11, wherein said clamp includes a base connecting said first leg to said second leg through a bend, said base being stiffer than at least one of said first leg and said second leg.

20. The lamp of claim 11, wherein an end portion of said third leg clamp includes a tongue which is transverse to said broad second surface.

21. The lamp of claim 11, further comprising:

an outer envelope surrounding said vessel, said pinch and said clamp; and a mount provided with a seal from which electrical conductors pass through for supplying power to an electric element in said vessel;

wherein said pinch is transverse to said seal; and wherein an end portion of said third leg includes a tongue which is transverse to said broad second surface, said tongue being fixed to one of said electrical conductors.

* * * * *